United States Patent [19]

Naporano et al.

[11] 3,972,481

[45] Aug. 3, 1976

[54] SHREDDING SYSTEM IMPROVEMENT TO SUPPRESS EXPLOSIONS

[75] Inventors: Joseph F. Naporano; Benjamin A. Baker, both of Livingston; Steven J. Tunkel, Whippany; Chester Grelecki, Rockaway; George L. Van Houten, Essex Fells, all of N.J.

[73] Assignee: Nimco Shredding Co., Newark, N.J.

[22] Filed: Dec. 18, 1974

[21] Appl. No.: 533,780

[52] U.S. Cl. ..... 241/30; 241/31

[51] Int. Cl.[2] ..... B02C 23/04

[58] Field of Search ..... 241/31, 58, 59, 30; 266/26; 165/134; 126/42, 84, 312; 34/51; 138/26; 220/89 A; 137/67, 68

[56] References Cited

UNITED STATES PATENTS

| | | | |
|---|---|---|---|
| 484,884 | 10/1892 | Schock | 241/31 |
| 1,415,216 | 5/1922 | Bingay | 220/89 A |
| 1,930,138 | 10/1933 | Van Derhoef | 220/89 A |
| 2,169,123 | 8/1939 | Galusha | 220/89 A |
| 2,555,280 | 5/1951 | Trumbull | 241/31 |
| 2,783,845 | 3/1957 | Mathisen | 241/31 |
| 2,905,358 | 9/1959 | Herbage | 220/89 A |
| 3,182,855 | 5/1965 | Stock | 220/89 A |
| 3,603,514 | 9/1971 | Williams | 241/31 |

*Primary Examiner*—Granville Y. Custer, Jr.
*Attorney, Agent, or Firm*—Ronald F. Weiszmann

[57] ABSTRACT

The present invention relates to an improvement in the process of and a device for shredding scrap automobiles, trucks, appliances, white goods and the like, which improvement substantially reduces and in most cases eliminates the damage from explosions during the process of and within the equipment for shredding scrap automobiles, trucks, white goods and the like by adequately venting the equipment during the process so as to prevent pressure build-up within the system after initiation of an explosion.

35 Claims, 9 Drawing Figures

SHREDDING SYSTEM IMPROVEMENT TO SUPPRESS EXPLOSIONS

BACKGROUND OF THE INVENTION

With the increased significance of recapturing scrap materials, particularly scrap metal, for recycling and reuse that has resulted from both environmental considerations and shortages in raw materials, the shredding and separating of large items of metal, for example, automobiles, trucks and white goods such as appliances, has developed into a significant industry. The equipment required to perform this task is large and complicated. The equipment normally icludes a hammer mill for breaking large items of metal and the like into smaller and denser "shredded" pieces of metal and various separation means for separating the metals both as to size and type of metal from the non-metallic materials. Shredded or shredding as used in this discussion refers to the breaking down of large, bulky items, such as automobile bodies, into smaller more easily handled pieces of metal and non-metallic materials. Since a large amount of dust and particulate matter is produced by this process, the equipment required also includes extensive dust collection devices. The typical dust collection device utilized comprises a cyclone separator device for separating the larger particles of dust and particulate material from the smaller; and a wet scrubber for the removal of the smaller particles and gaseous materials prior to the release of any exhaust into the atmosphere. The above mentioned cyclones and scrubber devices are well known and typical in the environmental field. The cyclone separator devices and scrubber are connected to the hammer mill by duct work through which dust and particulate material is drawn from the hammer mill to the dust collection equipment by means of a draw fan which creates a negative pressure between the fan and hammer mill within the duct work so that dust and particulate matter is drawn from the hammer mill to the dust collection equipment. A positive pressure is maintained between the fan and the scrubber. A typical example of the type of equipment utilized in this industry is the Newell Shredding System which is manufactured by the Newell Manufacturing Company, San Antonio, Texas.

Frequently, the source for scrap metal to be shredded in the above described system are old car bodies and appliances. The car body or appliance is fed intact into the hammer mill where it is shredded as discussed above. Periodically, despite severe prevention methods and continuous inspections, a car body is introduced into the system complete with its gasoline tank intact containing in general hydrocarbons and particularly gasoline. When this gasoline tank is introduced into the hammer mill, it is ruptured and any hydrocarbons or gasoline present are vaporized to fumes which are drawn into the duct work system, dust collector, fan and scrubber. The hammer mill at this time also creates sparks as a result of contact between the metal being shredded and the metallic elements of the hammer mill. These sparks combined with the disbursed hydrocarbon vapors, the particulate nature of dust and the other particulate matters present in the system frequently form the basis for violent explosions, which have the capability of causing great destruction and human injuries.

SUMMARY OF THE INVENTION

The present invention, by providing venting devices located throughout the system having a predetermined venting area relationship to the total volume of the system and being designed to release and vent at a predetermined internal pressure within the system, prevents explosions of gasoline fumes and particulate matter from causing damage by reducing or minimizing the effects of the explosion. This is accomplished by relieving pressure produced before the explosion reaches damaging energy levels. It has been determined that the ratio of venting area to total volume within the system should be within the range of from five square feet of venting area for each one hundred cubic feet of volume within the system to ten square feet of venting area for each one hundred cubic feet of volume within the system. It has also been determined that the venting devices should release and vent when the internal pressure within the system reaches a level within the range of 0.2 psig to 1.0 psig. By providing venting means to a scrap metal shredding system as will be more fully described hereafter, this invention has substantially reduced, and in most cases effectively eliminated, damage from explosions within the system and the destruction and injury caused by such explosions.

OBJECT OF THE INVENTION

A first object to the present invention is to prevent damage to personnel and equipment from an explosion within a scrap metal shredding system.

A second object of the present invention is to provide to a scrap metal shredding system proper venting devices to prevent pressure build-ups within the system during explosions capable of producing damage to the system.

Other objects of the invention are apparent from the detailed description of the invention.

DETAILED DESCRIPTION OF THE INVENTION

Figure 1:
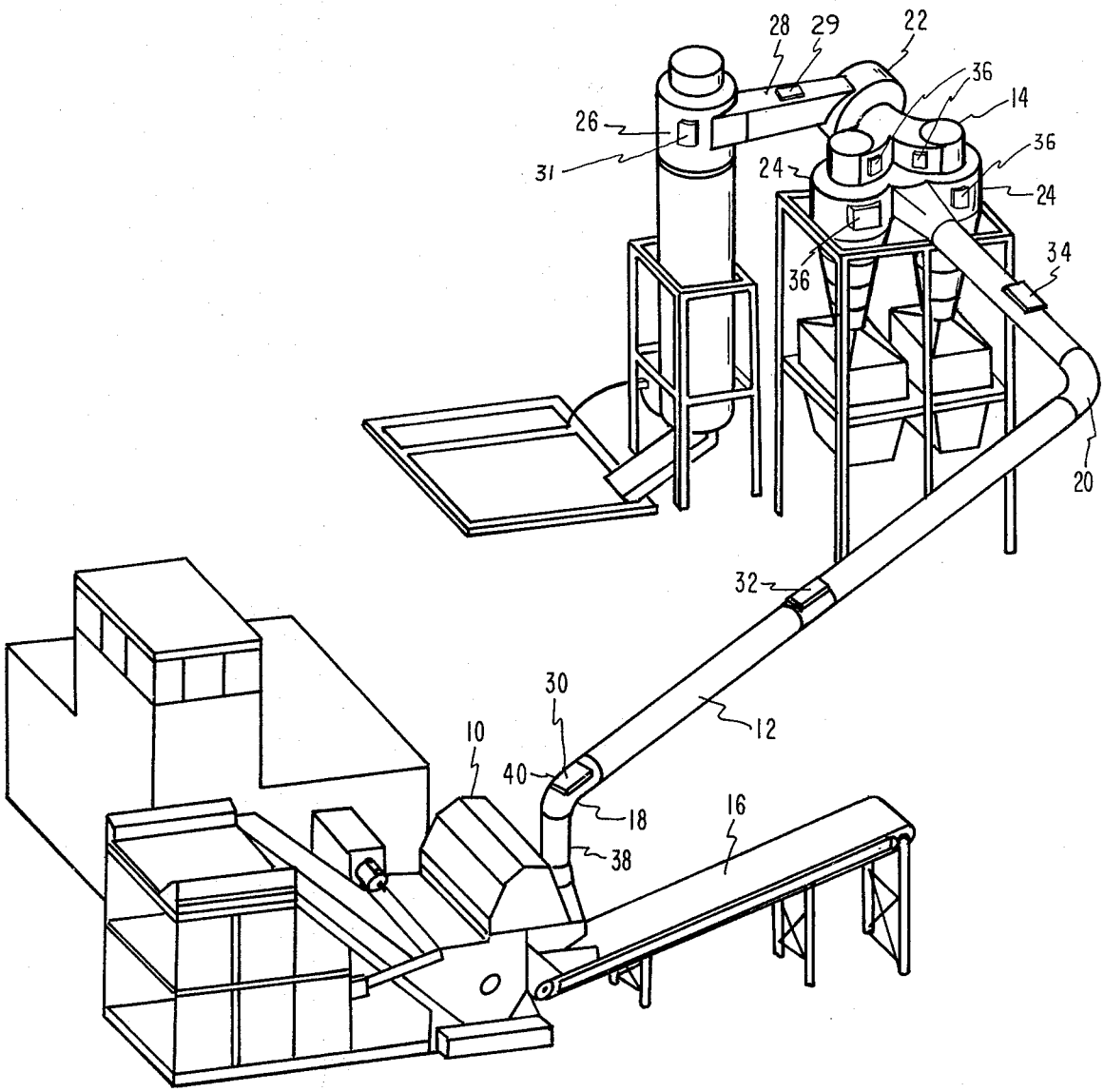
FIG. 1 is a schematic view of the pertinent parts of a scrap metal shredding system.

Referring to FIG. 1 of the drawings, the present invention relates to a shredding system for the shredding of scrap metal or the like and which comprises a hammer mill 10, duct work 12, dust collector 14, and conveying means 16 for carrying away the shredded or scrap metal or the like. The duct work 12 connects the dust collector 14 to the hammer mill 10 and, because of the large size of the individual elements of the system and the great distance between them, duct work 12 includes one or more elbows 18 and 20 which form bends in the duct work 12. The dust collector 14 comprises a draw fan 22 which draws dust and particulate matter from the hammer mill 10 through the duct work 12 to the dust collector 14, one or more cyclone air separators 24, a wet scrubber 26, and duct work 28 joining the fan 22 to the scrubber 26.

Venting devices 29, 30, 31, 32, 34, and 36 are located throughout the system, primarily on duct work 12, but also on cyclone 24. With the exception of venting device 30, which will be more fully discussed later in reference to FIG. 2, the precise location of venting device 29, 31, 32, 34, and 36, and other is not a material part of this invention. Logic suggests that at least some venting devices be provided on or adjacent each separate part of the system; i.e., the hammer mill, dust collector, the duct work, the cyclone, the cyclone duct work and the scrubber. The fan is considered part of the system but no duct work is located thereon. Also, the venting devices should be located near the entrance to each separate section of the dust collection system, which may be viewed as individual components. Such location of the venting devices near the entrance to each individual component has been found to be the most efficient placement of the venting devices.

It has been also determined that the relationship between the venting area and the total volume of the system must be within the range of 5 square feet of venting area for each one hundred cubic feet of volume within the system to 10 square feet of venting area for each one hundred cubic feet of volume within the system. The volume of the system as used herein encompasses the volume of hammer mill, duct work to the cyclones, cyclone, fan duct work to scrubber and scrubber.

Another important element of the invention involves the internal pressure within the system which must be attained before the venting devices will release and allow venting. It has been found that the venting devices must release and allow venting when the pressure within the system reaches the level of and within the range of from 0.2 psig to 1.0 psig positive. When venting occurs at these pressures, combustion which has been initiated within the system will not create damaging explosions. Although the phenomena is not totally clear, it seems that a pressure release at the initiation of combustion allows the contained mixture of gas vapors and particulate matter to avoid pressurization necessary for the combustion to result in a damaging explosion. The types of materials available to provide venting at these control pressures will be discussed further later in this disclosure with reference to FIGS. 3 through 5.

Figure 2:
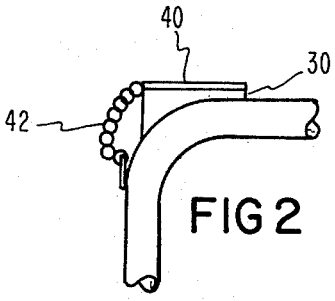
FIG. 2 is a detailed schematic representation of a first embodiment of the venting device of this invention.

With reference to FIG. 2 of the drawings, venting device 30 is located on the upstream arm 38 of elbow 18 which elbow is the elbow within the duct work nearest to the hammer mill 10. This location of venting device 30 is very important to the present invention for the reason that it has been determined that the majority of explosions initiate in the hammer mill 10. Dust and particulate matter being drawn through the duct work 12 by the fan 22 move through elbow 18 at a particular velocity. When combustion is initiated in the hammer mill 10, the velocity of the dust and particulate material through elbow 18 increases thereby locally increasing the internal pressure within the system at the point of elbow 18. By placing vent 30 directly in the path of this increased velocity, venting device 30 is capable of releasing and venting as a result of the increased velocity which may not have as yet altered the internal pressure within the system as a whole adequate to cause venting devices 29, 31, 32, 34, 36, and others to release and allow venting. Consequently, by positioning vent 30 on the upstream arm 38 of elbow 18, added safety is attained by quick release and venting even prior to venting of the system as a whole. Venting device 30 includes a cover 40 which may be of any material utilized in the venting devices throughout the system as will be discussed later with reference to FIGS. 3 through 5. If cover 40 of the venting device 30 is a rigid or semi-rigid material, chain 42 may be included to assure that cover 40 does not act as a projectile upon the release and venting of venting device 30.

An alternative method of preventing the covers from flying about includes a metal frame structure extending approximately two feet over the cover and encompassing the cover made of rolled angles or other sturctural steel and covered with cyclone fence or caging material.

Although it might be conceivable to design a system with no elbows or direction changes between the cyclones and hammer mill, it has appeared impractical to date and in addition pressure relief venting might become even more difficult.

Figure 3:
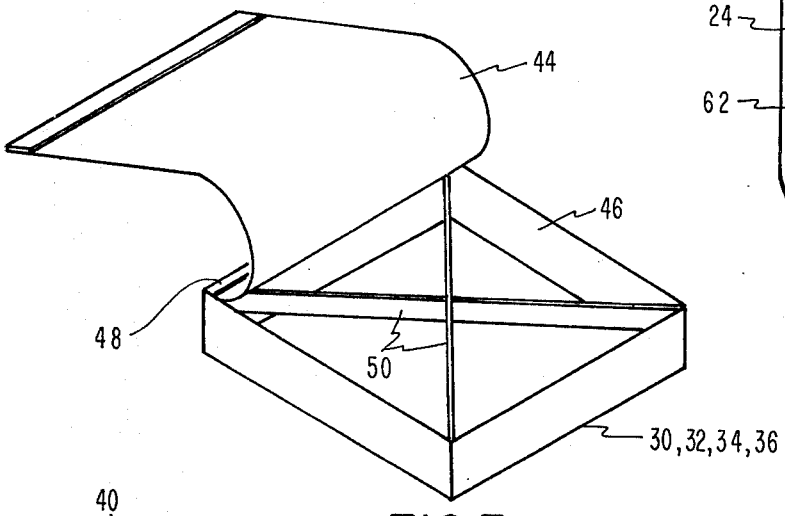
FIG. 3 is a schematic representation of a second embodiment of the venting device of this invention.

With reference to FIG. 3, any one of the venting devices 30, 32, 34, or 36 may include a cover 44 which comprises a sheet of rubberized flexible fabric. A cover 44 is secured to a framework 46 of venting device 30, 32, 34, or 36 through only a limited portion of its periphery, as shown at 48 in FIG. 3. If venting devices 30, 32, 34, or 36 are rectangular, as shown in FIG. 3, although any other shape is contemplated by this invention, then the limited area of the periphery 48 of cover 44 could be one of four sides of the cover 44. In this embodiment, the venting device 30, 32, 34, and 36 includes an underlying support structure 50 upon which cover 44 rests. This embodiment of the venting device 30, 32, 34, and 36 may be utilized anywhere between the hammer mill 10 and the draw fan 22 for the reason that draw fan 22 has created a negative pressure within the hammer mill 10, the duct work 12 and the parts of the dust collector 14 between the fan 22 and the duct work 12. Consequently, the flexible cover 44 will be held in closed position by the negative pressure within the system. The periphery of cover 44 may be sealed to prevent leakage within any well-known sealing material, such as caulking. The weight of the rubberized fabric cover 44 should be such that cover 44 will remain in position until the internal pressure within the system has reached a predetermined level at which the flexible cover 44 will simply open as shown in FIG. 3. Another and similar embodiment to that shown in FIG. 3, which embodiment is not included in the drawings, comprises the venting device 30, 32, 34, 36, complete with support structure 50, covered by a rupturable metallic foil material, or any other similar material having an extremely low rupture point.

Figure 4:
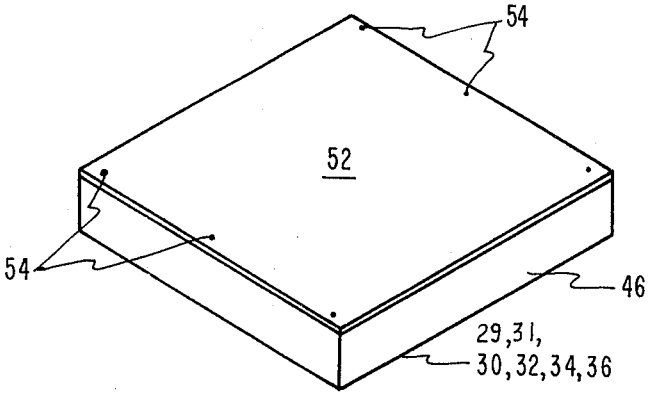
FIG. 4 is a schematic representation of the third embodiment of the venting device of this invention.

With reference to FIG. 4 a further embodiment is shown in which the venting device 29, 30, 31, 32, 34, 36, includes a cover 52 constructed of a rigid or semi-rigid material and secured to the framework 46 of the venting device 29, 30, 31, 32, 34, 36, by breakaway fasteners 54 of known tensile strength which release at a predetermined force being exerted upon the rigid or semi-rigid cover 52 as a result of internal pressure within the system attaining a predescribed level. Venting devices 29 and 31 are set to hold up to a positive pressure of approximately 0.5 to 1.25 psig.

Figure 5:
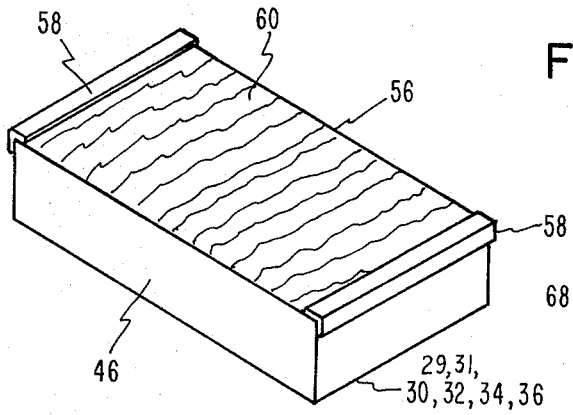
FIG. 5 is a schematic representation of the fourth embodiment of the venting device of this invention.

A further embodiment is shown in FIG. 5 in which the venting device 29, 30, 31, 32, 34, or 36, includes a cover 56 which is a plywood material which is rectangular and which is secured to the framework 46 of the venting device 29, 30, 31, 32, 34, or 36, along its two short sides 58. One vertical leg of 58 is welded to the frame so that 56 can be slid under the horizontal leg. In this embodiment, the plywood cover 56 is so positioned that its direction of grain 60 is parallel to the two short sides 58 secured to the framework 46 of the venting device 29, 30, 31, 32, 34, or 36. A tensile test was conducted with a sample provided of 2 foot by 3 foot plywood which was cut and supported as in the mill. Results indicated that this plywood panel failed at 9.0 plus or minus 1.5 psi, a pressure level in excess of other pressure levels of the system.

Figure 6:
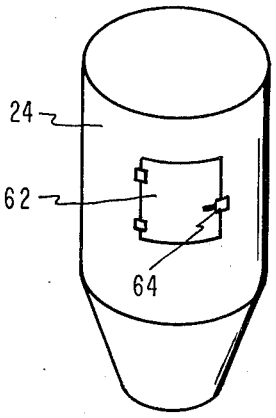
FIG. 6 is a schematic representation of an access door to the cyclone air separator showing the use of a venting latch on the access door.
Figure 7:
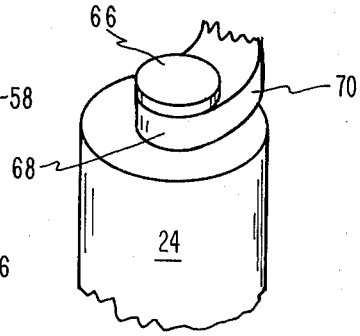
FIG. 7 is a schematic representation of the liftoff cyclone transition piece.
Figure 8:
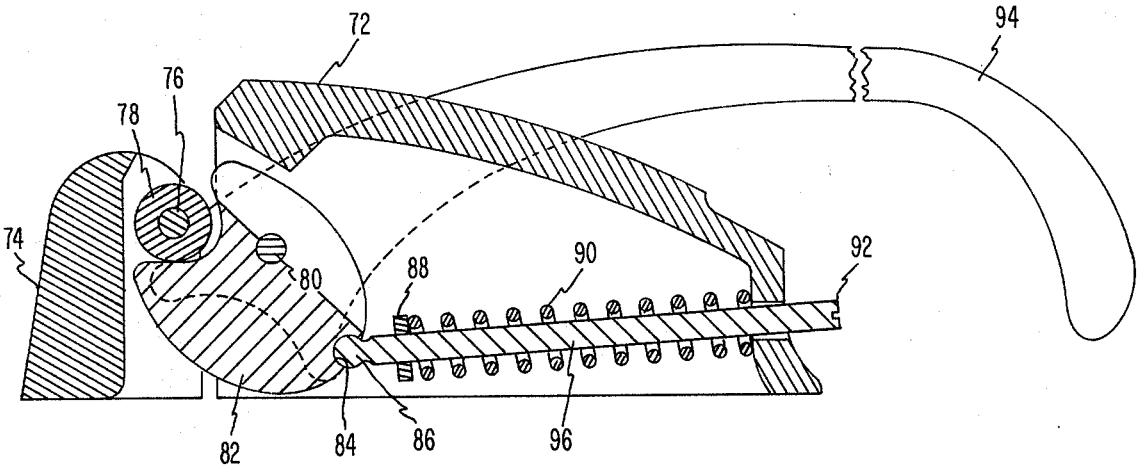
FIG. 8 is details of the latch.

FIGS. 6 and 7 refer to a cyclone air separator 24 which, of necessity, includes an access door 62 which is used for inspection and cleaning of the cyclone air separator. This access door 62 may also be adapted to provide venting of the cyclone 24 by providing a pressure release latch 64. The latch 64 may be any one of many well known such latches, for example, any one of many safety latches manufactured by Brixon Manufacturing Company, St. Paul, Minn. such as Models No. 1H, 2H, 3H, and in particular 4H. In addition, as seen in FIG. 7, the cyclone or cyclones 24 may be provided with a liftoff lid 66 resting on transition discharge 68 which joins the cyclone 24 to duct work 70 leading to fan 22. Lid 66 remains unsecured to the transitional discharge 68, and remains in position by its own weight and negative pressure from within the system. Referring to FIG. 8 of the drawings, the latch parts are as follows: 72 is the latch body; 74 is the strike; 76 is the roller pin; 78 is the roller of hardened steel; 80 is the bearing shaft; 82 is the laminated cam; 84 is the ball slot in laminated cam; 86 is the ball joint assembly; 88 is the spring nut; 90 is the spring; 92 is one end of the adjustment screw containing a screwdriver slot; 94 is the handle; and 96 is the adjustment screw.

Figure 9:
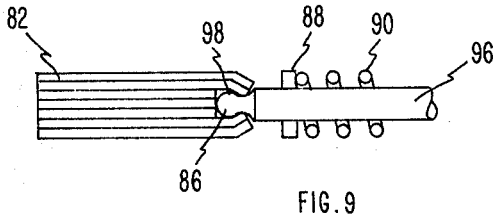
FIG. 9 is details of the adjustment screw.

Referring to FIG. 9 of the drawings, the adjustment screw parts are as follows: 82 is the laminated cam; 86 is the ball joint assembly; 88 is the spring nut; 90 is the spring; 96 is the adjustment screw; and 98 is the ball positioned at the end of the adjustment screw which interacts with ball joint 84.

OPERATION

In operation hydrocarbon vapors or the like are introduced into the system as a result of a gasoline tank containing gasoline entering the hamamer mill 10 and being ruptured thereby, and sparks being produced in the hammer mill 10 sufficient to ignite the combination of hydrocarbon fumes and particulate matter present in the system. Initiation of that ignition will cause an increase in the internal pressure of the system leading toward a maximum explosion pressure. As the internal pressure builds, venting devices 29, 30, 31, 32, 34, and 36, and any other venting devices will release and allow venting of the system. This venting prevents the build-up of internal pressure within the system and allows the gasoline vapor and particulate matter to remain unpressurized such that the impending explosion does not reach such pressure that the equipment itself fails and is hurled about. Consequently, the plant operators simply close the venting devices 29, 30, 31, 32, 34, and 36, and resume operation of the shredding system. Such an occurrence no longer results in damage and destruction to the equipment and significant periods of inoperation while the system is being repaired, and the previously ever present danger of injury to personnel.

The above described improvement to the process and device for shredding scrap metal may be used in conjunction with other suppression devices, e.g. the Fenwal Suppression System, or any other similar device such as a spark inhibitor, gas vapor detector, or the like.

What we claim is:

1. An improvement in the process for shredding scrap metal and the like including the scrap metal in a hammer mill, separating the reduced scrap metal emerging from the hammer mill, collecting dust and the like from the process of reducing scrap metal in the hammer mill, and feeding the dust and the like through duct work from the hammer mill to a dust collector, the improvement for the elimination of damage from explosions comprising:

a. Venting internal pressure through venting devices adapted to vent when internal pressure within the hammer mill, duct work and dust collector reaches a level within the range of 0.2 psig to 1.25 psig.

2. An improvement as claimed in claim 1 comprising:

a. Venting internal pressure through venting devices at least one of which venting devices vents in response to localized internal pressure caused by an increase in the velocity of a flow of gaseous and dust material against a directional changing portion of the duct work.

3. The improvement in a process for shredding scrap metal and the like including reducing the scrap metal in a hammer mill, separating the reduced scrap metal emerging from the hammer mill, collecting dust and the like from the process of reducing scrap metal in the hammer mill, and feeding the dust and the like through duct work from the hammer mill to a dust collector, the improvement for the elimination of damage from explosions comprising:

a. Venting internal pressure through venting devices at least one of which venting devices vents in response to localized pressure caused by the increase in the velocity of a flow of gaseous and dust material against a directional changing portion of the duct work.

4. Improvement to a shredding system which includes a hammer mill, a dust collector and duct work, which improvement minimizes damage from explosions in the system and comprises:

a. Venting devices located throughout the system having a total venting area within the range of from 5 square feet to 10 square feet of venting area for each 100 cubic feet of volume within the system being vented and wherein the venting devices are adapted to vent when internal pressure within the system reaches a level within the range of from 0.2 psig to 1.0 psig.

5. Improvement as claimed in claim 4 wherein:

a. The venting devices are located on the duct work portions of the shredding system.

6. Improvement as claimed in claim 4 wherein:

a. The venting devices comprise openings in the duct work covered by rupturable metallic foil designed to release upon application of a predetermined force.

7. Improvement as claimed in claim 6 wherein:
a. The rupturable metallic foil is underlaid by a framework within the opening in the duct work.

8. Improvement as claimed in claim 4 wherein:
a. The venting device comprises openings in the duct work covered by a flexible, rubberized fabric cover secured to the duct work by a limited portion of the periphery of the fabric cover designed to release upon application of a predetermined force.

9. Improvement as claimed in claim 4 wherein:
a. The venting device comprises openings in the duct work covered by a semi-rigid cover secured to the duct work by releasable fasteners adapted to release upon application of a predetermined force.

10. Improvement as claimed in claim 9 wherein:
a. The semi-rigid cover is plywood.

11. Improvement as claimed in claim 4 wherein:
a. The venting device comprises rectangular openings in the duct work covered by rectangular plywood covers secured to the duct work on two opposing sides,
b. The plywood cover has a surface ply having a grain parallel to the two opposing sides of the plywood cover, and
c. Said venting device is designed to release upon application of a predetermined force.

12. Improvement as claimed in claim 4 wherein:
a. A portion of the duct work includes an elbow,
b. The venting devices comprise at least one vent located on an arm of the elbow, which arm is upstream from the elbow in the direction of the flow of dust from the hammer mill to the dust collector, and
c. Said venting device is designed to release upon application of a predetermined force.

13. Improvement as claimed in claim 4 wherein:
a. The dust collector includes a fan which draws from the hammer mill through part of the duct work and into the dust collector, a cyclone air separator and additional duct work joining the fan to the cyclone air separator, and
b. The venting devices include a detachable cover located on the cyclone air separator where it joins the additional duct work, the cover being detachably secured to the cyclone air separator such that the cover detaches from the cyclone air separator upon application of a predetermined force.

14. Improvement as claimed in claim 13 wherein:
a. The cyclone air separator includes one or more access doors, and
b. The access doors contain latches adapted to release upon application of a predetermined force.

15. Improvement to a shredding system which includes a hammer mill, a dust collector and duct work, which improvement minimizes damage from explosions in the system and comprises:
a. Venting devices located throughout the system adapted to vent when internal pressure within the system reaches a level within the range of from 0.2 psig to 1.25 psig.

16. Improvement as claimed in claim 15 wherein:
a. At least some of the venting devices are located on the duct work portions of the shredding system.

17. Improvement as claimed in claim 15 wherein:
a. The venting devices comprise openings in the duct work covered by rupturable metallic foil designed to release upon application of a predetermined force.

18. Improvement as claimed in claim 17 wherein:
a. The rupturable metallic foil is underlaid by a framework within the opening in the duct work.

19. Improvement as claimed in claim 15 wherein:
a. The venting device comprises openings in the duct work covered by a flexible, rubberized fabric cover secured to the duct work by a limited portion of the periphery of the fabric cover and wherein the fabric cover is designed to release upon application of a predetermined force.

20. Improvement as claimed in claim 15 wherein:
a. The venting device comprises openings in the duct work covered by a semi-rigid cover secured to the duct work by releasable fasteners adapted to release upon application of a predetermined force.

21. Improvement as claimed in claim 20 wherein:
a. The semi-rigid cover is plywood.

22. Improvement as claimed in claim 15 wherein:
a. The venting device comprises rectangular openings in the duct work covered by rectangular plywood covers secured to the duct work on two opposing sides,
b. The polywood cover has a surface ply having a grain parallel to the two opposing sides of the plywood cover, and
c. Said venting device is designed to release upon application of a predetermined force.

23. Improvement as claimed in claim 15 wherein:
a. The venting devices are adapted to vent when the internal pressure within the system reaches a level of 0.5 psig.

24. Improvement as claimed in claim 15 wherein:
a. A portion of the duct work includes an elbow,
b. The venting devices comprise at least one vent located on an arm of the elbow, which arm is upstream from the elbow in the direction of the flow of dust from the hammer mill to the dust collector, and
c. Said venting device is designed to release upon application of a predetermined force.

25. Improvement as claimed in claim 15 wherein:
a. The dust collector includes a fan which draws dust from the hammer mill through part of the duct work and into the dust collector, a cyclone air separator and additional duct work joining the fan to the cyclone air separator, and
b. The venting devices include a detachable cover on the cyclone air separator when it joins the additional duct work, the cover being detachably secured to the cyclone air separator such that the cover detaches from the cyclone air separator upon application of a predetermined force.

26. Improvement as claimed in claim 25 wherein:
a. The cyclone air separator includes one or more access doors, and
b. The access doors contain latches adapted to release upon application of a predetermined force.

27. An improvement to a shredding system which includes a hammer mill, a dust collector and duct work joining the hammer mill to the dust collector and having at least one elbow, which improvement prevents damage from explosions in the system and comprises:
a. The elbow having a first arm and a second arm oblique to the first arm,
b. The elbow being so positioned that the first arm is closer to the hammer mill than is the second arm, and such that gaseous and dust material flowing from the hammer mill to the dust collector flows into the first arm and is redirected obliquely to the first arm by the elbow prior to entering the second arm, c. A venting device located on the elbow such that the gaseous and dust material strikes the venting device prior to being redirected into the second arm, and d. Said venting device is designed to release upon application of a predetermined force.

28. An improvement as claimed in claim 27 wherein:

a. The venting device is adapted to vent when internal pressure within the system at the location of the venting device reaches a level of 0.5 psig.

29. An improvement as claimed in claim 27 wherein:

a. The venting devices comprise openings in the duct work covered by rupturable metallic foil.

30. An improvement as claimed in claim 29 wherein:

a. The rupturable metallic foil is underlaid by a framework within the opening in the duct work.

31. An improvement as claimed in claim 27 wherein:

a. The venting device comprises openings in the duct work covered by a flexible, rubberized fabric cover secured to the duct work by a limited portion of the periphery of the fabric cover.

32. An improvement as claimed in claim 27 wherein:

a. The dust collector includes one or more access doors, and b. The access doors contain latches adapted to release upon application of a predetermined force.

33. An improvement in the process for shredding scrap metal and the like including shredding the scrap metal in a hammer mill, separating the shredding scrap metal emerging from the hammer mill, collecting dust and the like from the process of shredding scrap metal in the hammer mill and feeding the dust and the like through duct work from the hammer mill to a dust collector, the improvement for the elimination of damage from explosions comprising:

a. Relieving excess internal pressure within the hammer mill, duct work, and dust collector by venting the duct work through venting devices having a total venting area within the range of from one square foot of venting areas for each ten cubic feet of volume within the hammer mill, duct work and dust collector to one square foot of venting area for each twenty cubic feet of volume within the hammer mill, duct work and dust collector.

34. An improvement as claimed in claim 33 comprising:

a. Venting internal pressure through venting devices adapted to vent when internal pressure within the hammer mill, duct work and dust collector reaches a level within the range of 0.2 psig to 1.25 psig.

35. An improvement as claimed in claim 33 comprising:

a. Venting internal pressure through venting devices at least one of which venting devices vent in response to localized internal pressure caused by an increase in the velocity of a flow of gaseous and dust material against a directional changing portion of the duct work.

* * * * *